United States Patent [19]

Arene et al.

[11] 4,406,209

[45] Sep. 27, 1983

[54] PROJECTILE-FIRING WEAPONS

[75] Inventors: Francois Arene, Paris; Bernard Castagner, Esbly; Jean-Serge Peyroux, Paris, all of France

[73] Assignee: Societe d'Etudes, de Realisations et d'Applications Techniques (S.E.R.A.T), France

[21] Appl. No.: 193,598

[22] Filed: Oct. 3, 1980

[30] Foreign Application Priority Data

Nov. 22, 1979 [FR] France ..... 79 28780

[51] Int. Cl.[3] ..... F41F 3/02

[52] U.S. Cl. ..... 89/1.701; 89/1 B

[58] Field of Search ..... 89/1 B, 1.701, 1.702, 89/1.7; 102/430, 437, 443, 433, 434

[56] References Cited

U.S. PATENT DOCUMENTS

| | | | |
|---|---|---|---|
| 3,404,598 | 10/1968 | Angelos | 89/1 B |
| 3,528,681 | 9/1970 | Ekstrom | 89/1 B X |
| 3,738,271 | 6/1973 | La Costa | 102/430 |
| 3,771,417 | 11/1973 | Schnäbele et al. | 89/1.702 X |
| 3,773,353 | 11/1973 | Trowbridge et al. | 102/443 X |
| 3,800,656 | 4/1974 | Schnäbele | 89/1 B X |
| 3,967,552 | 7/1976 | Settles et al. | 102/430 |
| 4,047,465 | 9/1977 | Wohlford | 89/1 B X |
| 4,050,351 | 9/1977 | Stauff | 89/1.701 |
| 4,132,148 | 1/1979 | Meistring et al. | 89/1.701 |

FOREIGN PATENT DOCUMENTS

| | | | |
|---|---|---|---|
| 404815 | 7/1943 | Italy | 89/1.7 |
| 233347 | 3/1926 | United Kingdom | 89/1.701 |

*Primary Examiner*—David H. Brown

*Attorney, Agent, or Firm*—Davis, Hoxie, Faithfull & Hapgood

[57] ABSTRACT

A projectile-firing weapon wherein the firing of the projectile is brought about, at least partly, by the unfolding of a flexible bag under the effect of a pressure within the bag.

14 Claims, 13 Drawing Figures

21
22
23
24
25
26
27
28
29
30
31

PROJECTILE-FIRING WEAPONS

This invention relates to projectile-firing weapons, and in particular, though not exclusively, individual infantry weapons.

Growing urbanization and the means that are available for taking action against unprotected infantry results in the latter taking up positions in enclosed premises or in protected areas of reduced dimensions. This has therefore resulted in the need for designing and providing individual infantry weapons having high performance and capable of being fired from such enclosures. These weapons may be of the kind for using against tanks, other vehicles, aircraft or personnel.

In most cases, the mobility and the armour of tanks, other vehicles and aircraft have increased significantly year by year. Modern weapons, and particularly individual infantry weapons, must therefore be lighter and more accurate, and of greater final efficiency.

The present invention seeks to provide improvements in weapons which can be fired from an enclosed space, as well as in all weapons whose ergonomic effects due to environment require to be limited, such effects resulting from noise, pressure, toxicity or the release of propulsive gases.

When a projectile is fired, acceleration is almost always promoted by the combustion of powder. When the gases generated by this combustion leave the combustion enclosure, they result in troublesome factors, the effect of which increase with the extent to which the space is confined and closed off. These factors are, in particular:

noise due to the expansion of the gases;
gas pressure wave;
impact due to the extent of movement of the gases;
flash (detectable by the enemy);
harmful fumes,
heat effects.

In the projectile-firing weapon of the invention, firing of the projectile is brought about, entirely or in part, by the unfolding of a flexible bag or pouch under the effect of an internal pressure.

In one form of construction of this weapon system, the pressure causing unfolding of the flexible propulsive bag is generated by the combustion of a propulsive charge, in particular a preferably solid propegol enclosed in the bag, expansion of the gases in the bag causing the projectile to accelerate, while the gases are retained in the bag, and the troublesome factors mentioned above are reduced or even almost eliminated.

The bag may be sealed at one side only, so as to permit slow controlled escape of the gases contained in the bag.

This system of retaining the propulsion gases, as proposed by the invention, by means of an unfoldable bag, is simple and reliable. It requires no means for restraining moving masses, so that considerable advantages accrue.

In a further arrangement in accordance with this invention, a ballast, positioned opposite the projectile, is provided in the firing tube, and the bag is placed between the projectile, on the one hand, and the ballast, on the other; this feature results in total or partial compensation of the recoil impulse caused by the firing of the projectile.

It should be stressed that the invention is applicable to all missiles, rockets, shells and projectiles fired from a tube closed at one of its ends, for example a cannon, a mortar or a howitzer, or from a tube open at both ends. Also, still within the ambit of the invention, the pouch may remain in the tube after firing, or may leave the tube at one or other of its ends.

To help understanding of the invention, two specific embodiments will now be described by way of example, and with reference to the accompanying drawings.

The first exemplary embodiment of the invention is an anti-tank non-recoil infantry weapon which can be fired from an enclosed space, and in which the dynamic balance of the projectile is ensured by means of a divided ballast mass.

The second exemplary embodiment is a weapon, the projectile of which is fired from a tube having a closed breech.

IN THE DRAWINGS

Figure 1:
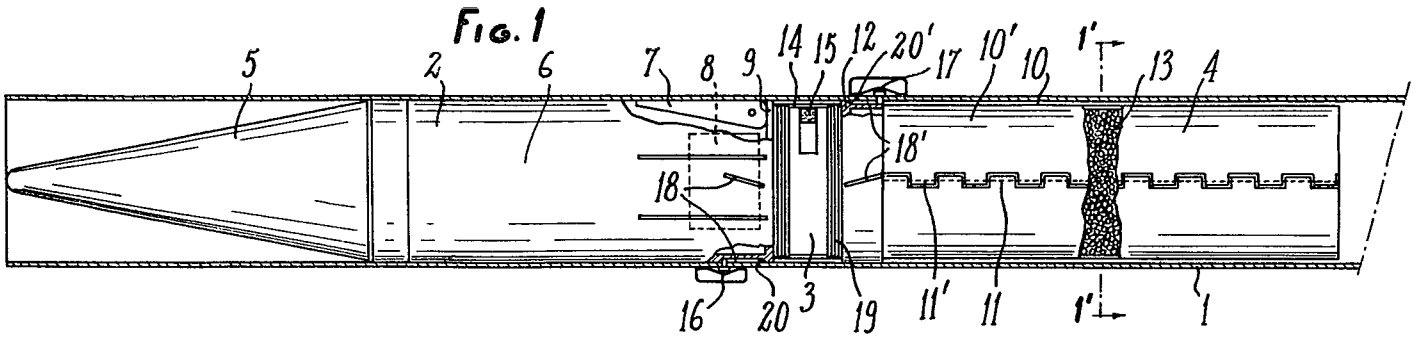
FIG. 1 is a longitudinal section through the non-recoil anti-tank infantry weapon of the first exemplary embodiment of the invention.
Figure 2:
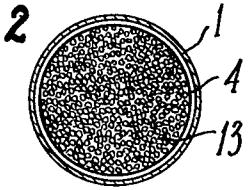
FIG. 2 is a section along line 1'-1' of FIG. 1.

Reference is first made to FIGS. 1 and 2, which illustrate the first embodiment of the invention relating to an anti-tank infantry weapon.

A projectile 2, an unfoldable propulsive bag 3 and ballast 4 are placed in a tube 1 of a weapon equipped with gripping, aiming and firing means, which are not illustrated. This weapon tube 1 is preferably made of wound fibre filaments, e.g. glass, aramide or carbon. This tube 1 may of course also be made of a metal, a composite structure, a tissue or other suitable material.

The projectile 2 comprises of contact cap 5, a charge 6, an unfoldable vane 7 and a safety fuse 8. The projectile 2 may also include other systems such as for detection, guiding, additional propulsion or release.

The ballast 4 consists of small elements 13 of low density and having high drag and lift coefficients and a high shock-absorption coefficient. These elements may be made, for example, of open-cell sponge material, or felt, though they are not limited to these materials. The elements 13 are enclosed in a case 10 which is undersize, so as to limit the friction forces of the case within the tube.

This tube 10 is formed by a number of thin layers 10' of textile material, which are joined together by, for example, a number of textile or steel wires 11. These wires 11, connected to the tube 1, slide in the folds 11' of the layers 10' at the moment when the ballast is ejected. This enables the thin layers 10' to become detached from each other and to release the elements 13 forming the ballast 4.

Alternatively, the elements 13 of the ballast may be fitted directly in the tube 1, downstream of the piston 12 to be described later, or in a rigid sheath which may or may not be connected to the propellant bag 3.

The unfoldable propellant bag 3 consists of a pouch 14, preferably of textile material. The folding 19 of this pouch is designed to ensure that the pouch unfolds readily under the effect of the gases generated by an explosive charge 15 contained therein.

FIGS. 6 to 9 illustrate one form of the folding of the unfoldable propellant bag 3. The folding is made in two stages, starting with a bag of generally cylindrical shape, illustrated in FIG. 6, on either side of the propellant charge contained in the central portion 3' of the bag.

Figure 7:
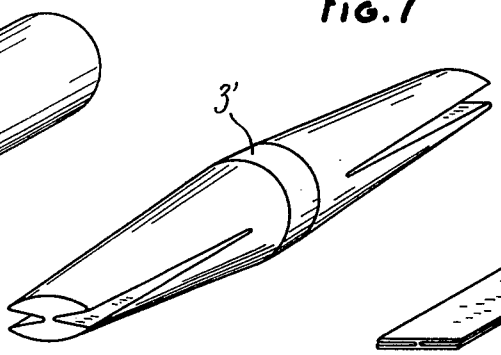
FIGS. 6 to 9 illustrate the various stages in the folding of the bag in the weapon of FIG. 1.
Figure 8:
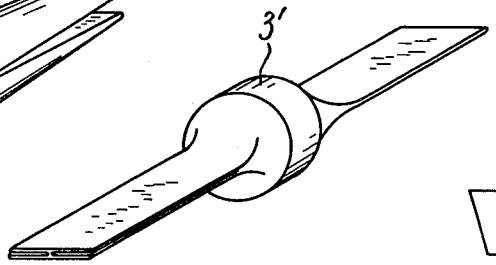
Figure 9:
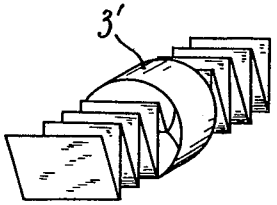
Figure 6:
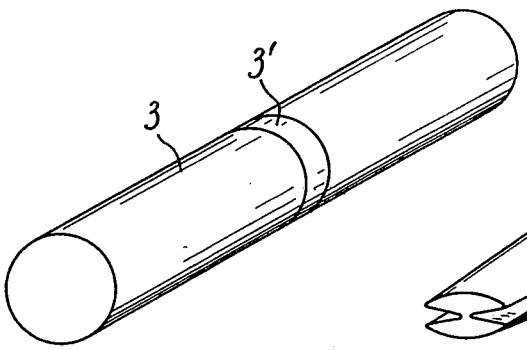

The first stage, shown in FIGS. 7 and 8, consists in a flat longitudinal folding of the cylinder with the two longitudinal edges folded inwardly to form a gusset, and the second stage, shown in FIG. 9, consists in transversely folding the double-gusset flat strip obtained in the first stage, so as to impart a zig-zag concertina shape thereto.

Alternatively other folding, which ensures ready unfolding of the bag during expansion caused by combustion gases from the propellant charge 15, may be employed. The pouch 14 is made of materials of high mechanical strength, for example aramide fibre tissues, protected against heat and rendered more pressure tight by a coating, for example of silicone or polyurethane resins, which may contain refractory materials such as silica, asbestos or oxides.

The same material may, at the same time, ensure mechanical strength, partial or complete pressure tightness and protection against heat.

The pouch 14 of the propellant bag 3 may also be undersize, in the case where the pressure is below a certain limit, corresponding, for example, to one-third of the maximum pressure; this enables the level of the frictional forces of the propellant bag 3, within the tube 1, to be limited, which forces are balanced because of the principle upon which the weapon is based.

It will therefore be understood that the propellant bag 3, on unfolding, applies a thrust to the projectile 2, on the one hand, and to the ballast 4, on the other, and this balances the degrees of movement. Interfaces are formed by two pistons 9 and 12. The front piston 9 is solidly applied to the projectile 2. It forms a thrust support which also acts as a guide in the unfolding movement. However, the thrust support may be independent of, or connected to, the propellant bag. The rear piston 12 is independent, but may be connected to the propellant bag 3 or the case 10 of the ballast 4.

The projectile 2 is caused to rotate by means of a retractable finger 16, connected to the tube, it enters and slides in an inclined groove 18, formed in the front piston 9. A similar rectractable finger device 17 imparts rolling motion to the rear piston 12 by means of a groove 18', so that the ballast 4 also turns. The rolling torque induced in the weapon can be offset. In this case, the relation between the inclination $\theta_1$ and $\theta_2$ of the front groove 18 and the rear groove 18', respectively, is in inverse ratio to the squares of the radii of gyration $\rho_1$ and $\rho_2$, respectively, of the projectile 2 and the assembly formed by the rear piston 12 and the ballast 4. If $I_1$ and $I_2$ are the inertias, and $\phi_1$ and $\phi_2$ are the rolling speeds, respectively, of the projectile 2 and the assembly consisting of the rear piston 12 and the ballast 4, then the following relationship is applied:

$$\frac{I_1\omega_1}{I_2\omega_2} = \frac{(\rho_1)^2\theta_1}{(\rho_2)^2\theta_2}$$

Other rolling torque relationships may be selected.

Alternatively, the projectile 2 may be caused to rotate by means of a helical folding, under torsion, of the pouch 14 of the propellant bag 3, which, on unfolding, produces the required rotational torques by way of the frictional and bearing forces; these torques are of opposite sign for the projectile 2, on the one hand, and the assembly comprising the rear piston 12 and the ballast 4, on the other.

Figure 3:
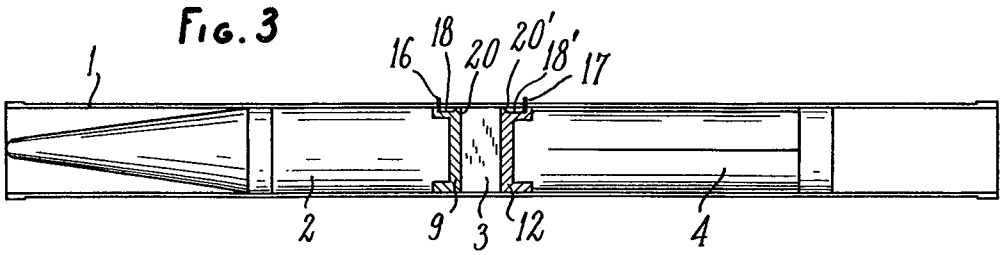
FIGS. 3 to 5 illustrate successive stages in the movement of the projectile and of the ballast of the weapon shown in FIG. 1.
Figure 4:
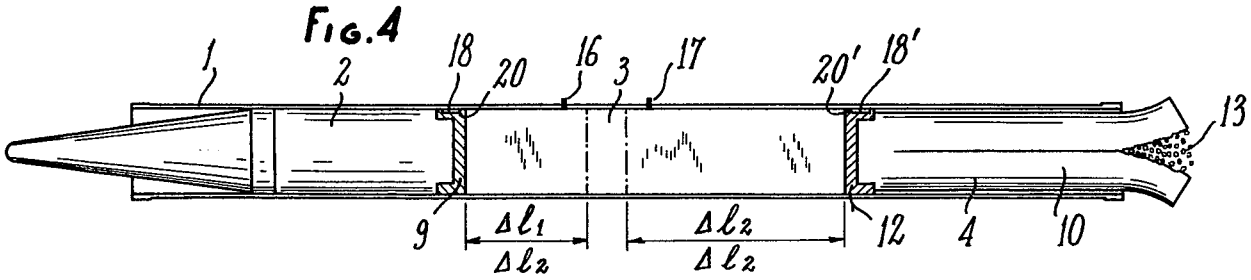
Figure 5:
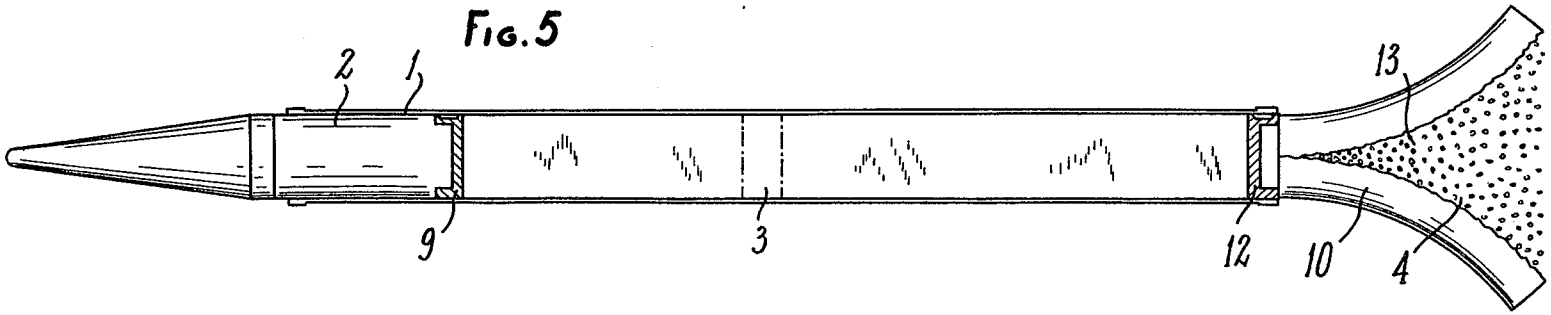

FIGS. 3 to 5 illustrate, in diagrammatic longitudinal section, the three main phases in the operation of the non-recoil anti-tank infantry weapon of the first embodiment of the invention.

FIG. 3 illustrates the weapon ready for firing.

The tube 1, open at its two ends, contains the projectile 2, to which the front piston 9 is solidly applied, as well as the folded propellant bag 3, the ballast 4 in its case 10, and its piston 12. The rotation-imparting fingers 16 and 17 are positioned at the ends of the grooves 18 and 18', respectively. Unfolding of the propellant bag takes place only above a limit pressure, which will be determined, for example, by the breakage of pins or wire clips interconnecting the projectile 2 and the ballast 4, or by a limit pressure in fracture of the propellant container.

FIG. 4 illustrates diagrammatically the weapon while it is being fired. The propellant bag 3 is partly unfolded under the effect of the pressure set up by combustion of the charge 15. The piston 9 and the piston 12 have advanced over distances $\Delta\rho_1$ and $\Delta\rho_2$, respectively, such that the rotation-imparting fingers 16 and 17 have moved along the grooves 18 and 18'. Because of the presence of ramps 20 and 20' at the ends of the grooves 18 and 18', respectively, the fingers 16 and 17 are blocked in the outer position, so as not to damage the propellant bag during the course of its unfolding.

The reciprocal bearing forces between, respectively, the fingers 16 and 17 and the grooves 18 and 18' will have caused the imparting of rotation to the projectile 2 and the assembly comprising the ballast 4 and the rear piston 12.

FIG. 5 illustrates diagrammatically the end of the firing operation. The propellant bag 3 is totally unfolded, the thin layers of the case 10 containing the elements 13 of the ballast 4 have become separated under the effect of the folding of the wires 11 which hold the layers of the case 10 together. The elements 13 of the ballast have been released. Under the effect of the centrifugal force, the ballast 4 and the rear piston 12 rotate, and, because of the aerodynamic forces, these elements 113 fly off and slow down very rapidly, so that most of their movement is lost before they encounter an obstacle in the closed area in which firing is to take place, without damage to the surrounding zone and injury to the user.

The projectile 2 leaves the tube 1.

Figures 10, 11, 12, 13:
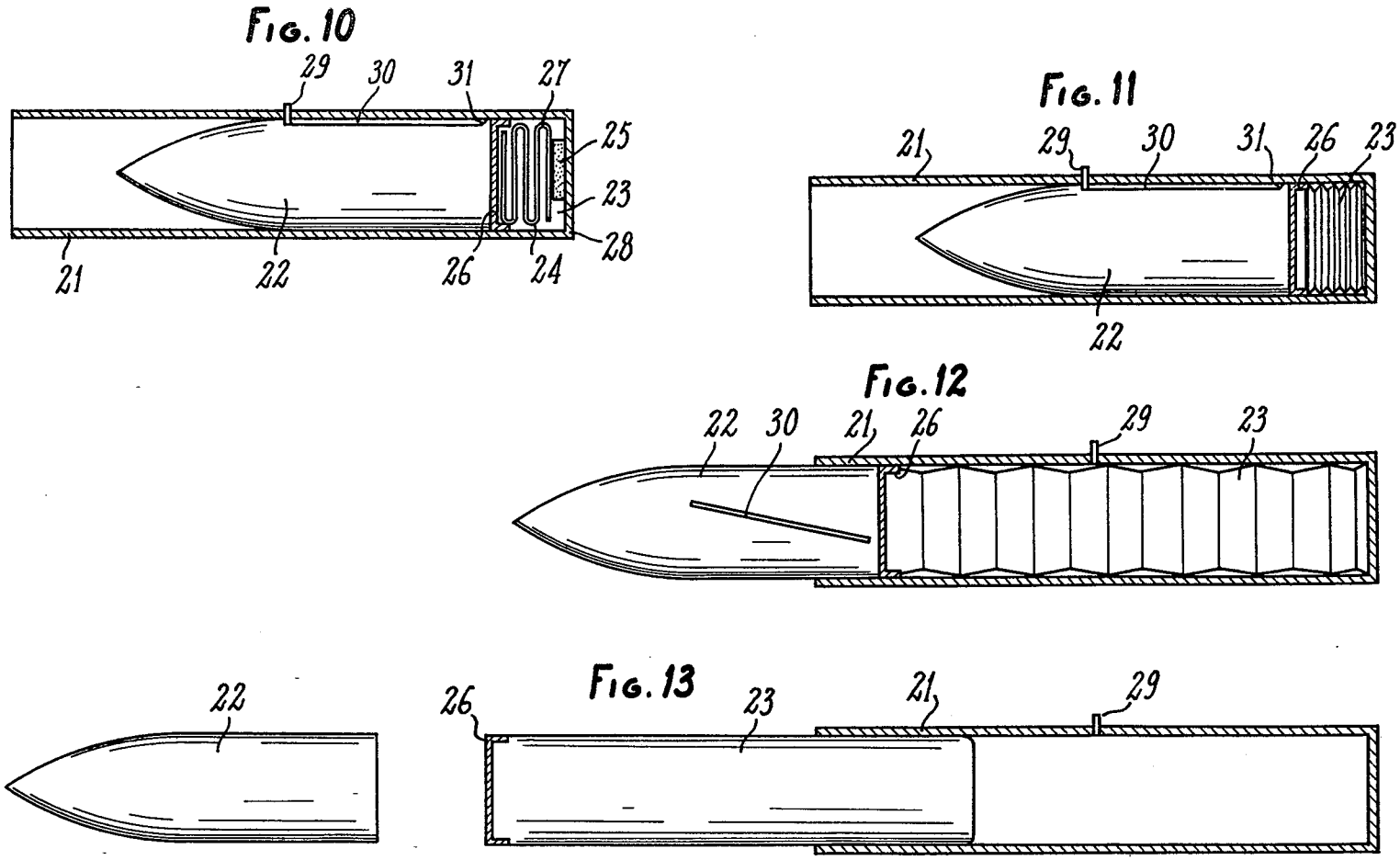
FIG. 10 is a diagrammatic longitudinal section through the cannon, with a closed breech, of the second exemplary embodiment of the invention; and, FIGS. 11 to 13 illustrate successive phases in the movement of the projectile and the unfolding of the bag associated with the weapon of FIG. 10.

Reference will now be made to FIG. 10, which illustrates the second embodiment of a weapon in accordance with the invention.

In this embodiment, the projectile 22 and the unfoldable propellant bag 23, similar to the bag 3, are placed in a tube 21 of a weapon, which tube is closed at its breech end. Depending upon the type of weapon system in which the invention is used, for instance a cannon, or a mortar, this tube 21 is mounted on a rest and is provided with various peripheral devices (not illustrated).

This weapon tube 21 is preferably made up entirely or partially by a filament winding, for example glass, aramide or carbon. However, it may also be made of metal, of a composite structure, or of woven or other suitable material.

The propellant bag 23 is constituted by a pouch 24, preferably made of textile material. The folding 27 is formed so as to ensure that the pouch can readily unfold under the effect of the gases generated by the powder charge 25.

The pouch 24 is made of a material providing mechanical strength; its pressure tightness and its protection against heat are increased by a covering. Mechanical strength, partial or total pressure tightness and protection against heat can be provided by one and the same material. The above details relating to the characteristics of the unfoldable bag 3 of the first embodiment of the invention also apply as regards the bag 23.

As the propellant bag 23 unfolds, it applies pressure to the projectile 22 and the bottom 28 of the firing tube 21. The interface between the propellant bag 23 and the projectile 22 is provided by a piston 26. This piston 26 may be of reduced size at the flexible wall 24 of the propellant bag 23. This piston 26 may be connected to, or independent of, the propellant bag 23.

The projectile is caused to roll by means of a retractable finger 29 connected to the tube and guided in an inclined groove 30, formed in the projectile 22. Alternatively, imparting of rolling motion to the projectile may be caused by the grooving in the firing tube; in this case, the propellant bag 23 and the piston 26, if present, are made undersize. In another alternative, the projectile may be caused to roll by means of a helical fold and twisting of the propellant bag 23, which, as it unfolds, sets up a rotational moment by way of the frictional forces.

Reference will now be made to the description of the first embodiment of a weapon in accordance with the invention, as regards the details of the arrangement of the bag and of the imparting of rotation in a system having an unfoldable propellant bag used in the case where the breech tube is closed.

FIGS. 11 to 13 illustrate diagrammatically and in longitudinal section the three main phases in the operation of the weapon system having a closed breech.

FIG. 11 illustrates the weapon ready for firing. The tube 21, open at one of its ends, contains the projectile 22, the folded propellant bag 23 and the piston 26 firmly connected to the propellant bag. The fingers 29 for imparting rolling movement are each positioned at the end of a groove 30.

FIG. 12 shows the weapon during the course of firing. The propellant bag 23 is partly unfolded under the effect of the pressure set up by combustion of the powder charge 25. The projectile 22 has advanced along the tube 21 under the effect of the thrust of the propellant bag 23, as it unfolds. The finger 29 for imparting rolling motion has moved along the groove 30, and, because of the presence of the ramp 31 formed at the end of this groove 30, it is blocked in the outer position, so as not to damage the propellant bag 23 as the latter unfolds. The reciprocal bearing forces between the finger 29 and the groove 30 will have caused the projectile 22 to roll.

FIG. 13 illustrates the end of the firing operation. The projectile 22 has left the tube. The projectile bag 23 is ejected forwardly because of the extent of the movement of the piston 26 and of the envelope 23. Thus, the tube is ready to receive a further complete shot consisting of a further projectile 22 and a further propellant bag 23.

Alternatively, the propellant bag 23 and the piston 26, if present, can be retained in the tube and can be extracted by any means other than that which uses its inherent distance of movement.

Blocking of the bag in the tube can be achieved, for example, with the aid of the rotation-imparting fingers 29 which, in this case, would not be retractable.

We claim:

1. A projectile firing weapon comprising a firing tube containing a projectile, a propellant charge for said projectile, and a container for said propellant charge, said container comprising a flexible cylindrical bag, said bag having a central portion containing said propellant charge and at least one end portion having a concertina configuration formed by first folding said end portion of the bag lengthwise to form a flat strip and then transversely folding the flat strip back upon itself in a zig-zag fashion, whereby upon ignition of said propellant charge, the zig-zag sections of the bag unfold one after another and only the section adjacent the propellant charge is subject to maximum pressure.

2. A weapon as claimed in claim 1, wherein the propellant charge is a propergol, particularly a solid propergol.

3. A weapon as claimed in claim 1, wherein the flexible bag is made of woven textile fibers such as aramide, carbon or glass fibres.

4. A weapon as claimed in claim 1, wherein the flexible bag, when unfolded, has a diameter slightly less than the bore of the firing tube, so that it moves into contact with the tube above a determined level of pressure, corresponding to a fraction of the maximum pressure.

5. A weapon as claimed in claim 1, wherein the flexible bag is covered by, or impregnated with, a product which ensures, at least partly, the pressure tightness and the thermal behaviour of the bag.

6. A weapon as claimed in claim 5, wherein the said product is selected within the group comprising a silicone and a polyurethane resin loaded with refractory elements.

7. A weapon as claimed in claim 1, comprising a ballast arranged in the tube towards the opposite end of the tube from the projectile, said flexible bag being positioned between the projectile and the ballast so as to ensure partial or total compensation of the recoil impulse caused by the firing of the projectile.

8. A weapon as claimed in claim 7, wherein the ballast consists of divided elements having high shock-absorbing and aerodynamic braking coefficients, the elements being made of felt or open-cell sponge material.

9. A weapon as claimed in claim 7, wherein unfolding of the bag commences only beyond a predetermined pressure limit.

10. A weapon as claimed in claim 7 and comprising two pistons associated with the projectile and the ballast, respectively, each of said pistons having a helical groove, and retractable fingers carried by said tube, for engaging said helical grooves to impart rolling movement to said projectile and said ballast.

11. A weapon as claimed in claim 10 wherein the slopes of the grooves for imparting a rolling motion to the projectile, on the one hand, and the ballast assembly, on the other, are respectively in inverse ratio to the square of their radius of gyration.

12. A weapon as claimed in claim 7, wherein the ballast, which compensates the extent of the movement of the projectile, is contained in a case solidly connected to the firing tube.

13. A weapon as claimed in claim 12, wherein the case is formed by a number of thin layers interconnected by a similar number of wires, which layers become separated at the moment when the ballast is ejected, so as to free elements which constitute it.

14. A weapon as claimed in claim 12 comprising means for imparting to the projectile and to the ballast rolling speeds of opposite sign.

* * * * *